US007628620B2

(12) United States Patent
Gritters

(10) Patent No.: US 7,628,620 B2
(45) Date of Patent: Dec. 8, 2009

(54) REINFORCED CONTACT ELEMENTS

(75) Inventor: John K. Gritters, Livermore, CA (US)

(73) Assignee: FormFactor, Inc., Livermore, CA (US)

( * ) Notice: Subject to any disclaimer, the term of this patent is extended or adjusted under 35 U.S.C. 154(b) by 0 days.

(21) Appl. No.: 12/135,309

(22) Filed: Jun. 9, 2008

(65) Prior Publication Data

US 2008/0238467 A1 Oct. 2, 2008

Related U.S. Application Data

(63) Continuation of application No. 11/611,874, filed on Dec. 17, 2006, now Pat. No. 7,384,277.

(51) Int. Cl.
*H01R 12/00* (2006.01)

(52) U.S. Cl. ..... 439/81; 439/839; 439/862

(58) Field of Classification Search ..... 439/81, 439/839, 862, 83

See application file for complete search history.

(56) References Cited

U.S. PATENT DOCUMENTS 3,781,770 A 12/1973 Mancini
4,431,252 A 2/1984 Cairns et al.
6,622,289 B2 9/2003 Saunders et al.
6,672,875 B1 1/2004 Mathieu et al.
6,724,204 B2 4/2004 Cho et al.
6,956,389 B1 10/2005 Mai
7,473,126 B1 * 1/2009 Chen et al. ..... 439/500
2003/0104731 A1 6/2003 Chang

OTHER PUBLICATIONS

Inoue, Tatsuo et al., "A novel probe-card for 8 inch full wafer contact using MLS," Micronics Japan Co., Ltd., 2005 South West Test Workshop, Jun. 5-8, 2005. Document as found on web page: http://www.swtest.org/swtw_library/2005proc/PDF/S05_02_Inoue-megna.pdf.

* cited by examiner

*Primary Examiner*—Gary F. Paumen
(74) *Attorney, Agent, or Firm*—N. Kenneth Burraston

(57) ABSTRACT

Embodiments of reinforced resilient elements and methods for fabricating same are provided herein. In one embodiment, a reinforced resilient element includes a resilient element configured to electrically probe an unpackaged semiconductor device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is not affixed to the resilient element.

37 Claims, 5 Drawing Sheets

REINFORCED CONTACT ELEMENTS

CROSS-REFERENCE TO RELATED APPLICATION

This application is a continuation of co-pending U.S. patent application Ser. No. 11/611,874, filed Dec. 17, 2006, which is herein incorporated by reference in its entirety.

BACKGROUND OF THE INVENTION

1. Field of the Invention

Embodiments of the present invention generally relate to reinforced resilient elements and more specifically, to reinforced resilient elements used in testing of semiconductor devices.

2. Description of the Related Art

Testing is an important step in the fabrication of semiconductor devices. Typically, partially or fully completed semiconductor devices are tested by bringing terminals disposed on an upper surface of a device to be tested—also referred to as a device under test (or DUT)—into contact with resilient contact elements, for example, as contained in a probe card assembly, as part of a test system. However, the reduction in the size of features formed on the DUT (for example, 50 microns and below) causes problems with the scalability of the resilient elements on the probe card. Specifically, the reduction in size of the resilient elements to facilitate contacting smaller features on the DUT increases the incidence of scrubbing off the contacting feature, or buckling and/or alignment problems with the resilient elements. Moreover, the reduction in size of the resilient elements increases the scrub ratio (defined as the amount of distance of forward movement across the contact feature to that of over-travel, or downward movement as the resilient element is moved past the point of contact with the DUT). The increase in scrub ratio of the resilient element restricts the over-travel budget required to establish proper electrical contact with the DUT without the resilient element scrubbing off the multiple DUT contact during probing. Moreover, multi-DUT testing with multiple resilient elements may require even greater probe over-travel to overcome non-planarity across the probing area to achieve simultaneous contact of all resilient elements.

Therefore, there is a need for an improved resilient element suitable for use in testing devices having smaller feature sizes.

SUMMARY OF THE INVENTION

Embodiments of reinforced resilient elements and methods for fabricating same are provided herein. In some embodiments, a reinforced resilient element includes a resilient element configured to electrically probe a device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is disposed in a spaced apart relation to the resilient element.

In some embodiments, a reinforced resilient element includes a resilient element having a first end, an opposing second end, and a tip disposed proximate the first end, the tip configured to contact a surface of a device to be tested; and a reinforcement member coupled to the resilient element and having a first end, a second end, and resilient portion disposed therebetween, wherein the resilient portion is disposed in a spaced apart relation to the resilient element and is configured to provide a rotational spring constant and an axial spring constant that is greater than the rotational spring constant.

In some embodiments, a probe card assembly for testing a semiconductor includes a probe substrate; and at least one reinforced resilient element coupled to the probe substrate, wherein the reinforced resilient element includes a resilient element configured to electrically probe a device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is disposed in a spaced apart relation to the resilient element.

In some embodiments, the invention provides a method of fabricating an apparatus for use in testing a device. In one embodiment, the method includes providing a resilient element configured to electrically probe the device to be tested, the resilient element having a first end and an opposing second end; and affixing a first end of a reinforcement member to the resilient element at the first end thereof or at a point disposed between the first and the second ends of the resilient element, wherein the reinforcement member has an opposing second end disposed in a direction towards the second end of the resilient element, and a resilient portion disposed between the first and second ends of the reinforcement member maintained in a spaced apart relation to the resilient element.

In some embodiments, the invention provides a method of testing a device. In one embodiment, the method includes providing a probe card assembly comprising a probe substrate having a plurality of reinforced resilient elements coupled thereto, wherein the reinforced resilient elements include a resilient element configured to electrically probe a device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is disposed in a spaced apart relation to the resilient element; contacting a plurality of terminals of the device with respective reinforced resilient elements; and providing one or more electrical signals to at least one of the terminals through the probe substrate.

In some embodiments, the invention provides a semiconductor device that has been tested by methods of the present invention. In some embodiments, a semiconductor device is provided that has been tested by providing a probe card assembly comprising a probe substrate having a plurality of reinforced resilient elements coupled thereto, wherein the reinforced resilient elements include a resilient element configured to electrically probe a device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is disposed in a spaced apart relation to the resilient element; contacting a plurality of terminals of the device with respective reinforced resilient elements; and providing one or more electrical signals to at least one of the terminals through the probe substrate.

BRIEF DESCRIPTION OF THE DRAWINGS

So that the manner in which the above recited features of the present invention can be understood in detail, a more particular description of the invention, briefly summarized above and others described below, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Where possible, identical reference numerals are used herein to designate identical elements that are common to the figures. The images used in the drawings are simplified for illustrative purposes and are not necessarily depicted to scale.

DETAILED DESCRIPTION

The present invention provides methods and apparatus suitable for testing devices having reduced contact feature sizes (e.g., under 50 microns). The inventive apparatus and methods can facilitate testing of such devices with reduced incidence of mis-probes by maintaining proper alignment with and contact to the devices. It is contemplated that the inventive apparatus and methods may also be used to advantage in testing devices having larger feature sizes as well. The inventive apparatus and methods can further provide a reduced scrub ratio. Reduced scrub ratio can advantageously reduce damage to the probing pad area on the DUT.

Figure 1:
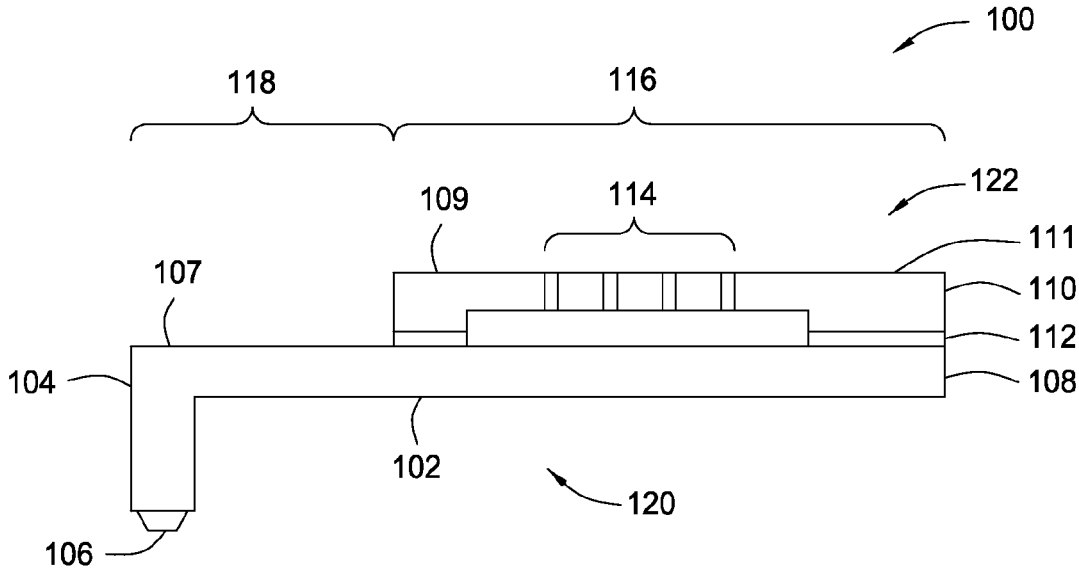
FIG. 1 depicts a schematic side view of one embodiment of a reinforced resilient element in accordance with some embodiments the present invention.

FIG. 1 depicts a schematic side view of one embodiment of a reinforced resilient element 100. The reinforced resilient element 100 includes a resilient element 120 and a reinforcement member 122. The resilient element 120 includes a beam 102 having a first end 107 and a second end 108. The beam 102 may comprise one or more layers and may comprise one or more electrically conductive materials. Examples of suitable materials include metals. In one embodiment, the beam 102 may comprise nickel (Ni), cobalt (Co), copper (Cu), beryllium (Be), and the like, and alloys thereof (such as nickel-cobalt alloys, copper-beryllium alloys, and the like).

A tip 104 is disposed proximate the first end 107 of the beam 102 and can include a contact 106 disposed on a distal portion of the tip 104 and can be configured for contacting a device to be tested. The beam 102, tip 104, and contact 106 may be integrally formed of the same material, or one or more of the beam 102, tip 104, and contact 106 may be separately formed from the same or different materials and subsequently coupled together. In addition to the materials described above with respect to the beam 102, suitable materials for fabricating the tip 104 and/or the contact 106 include noble metals.

Figure 2A:
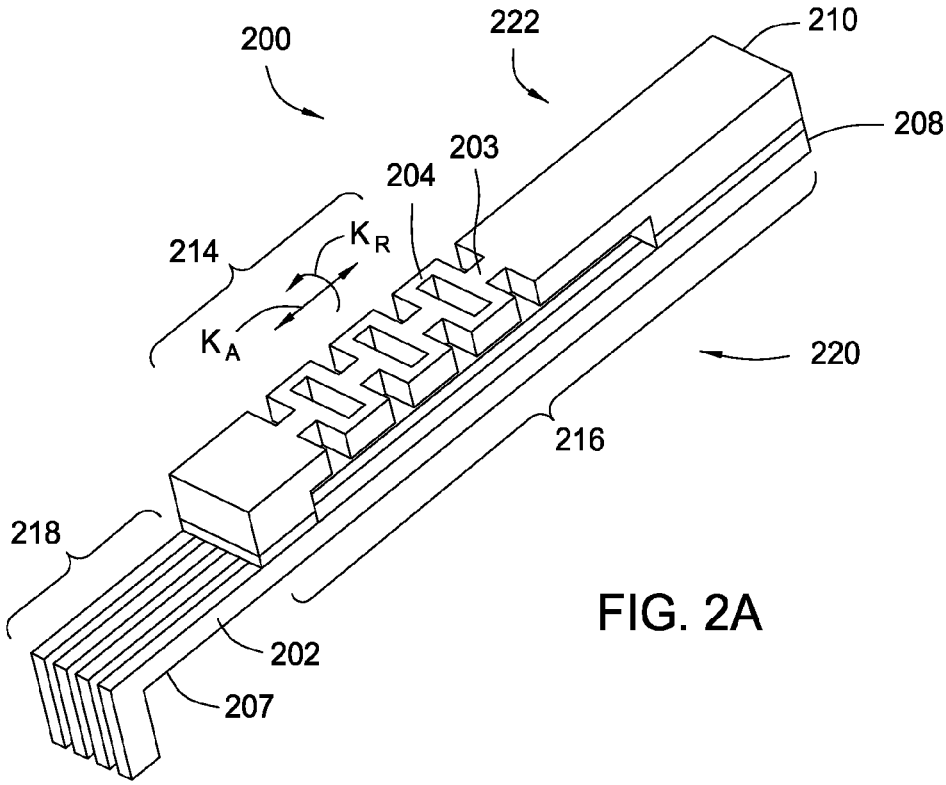
FIGS. 2A-B depict isometric views of some embodiments of a reinforced resilient element in accordance with some embodiments the present invention.
Figure 2B:
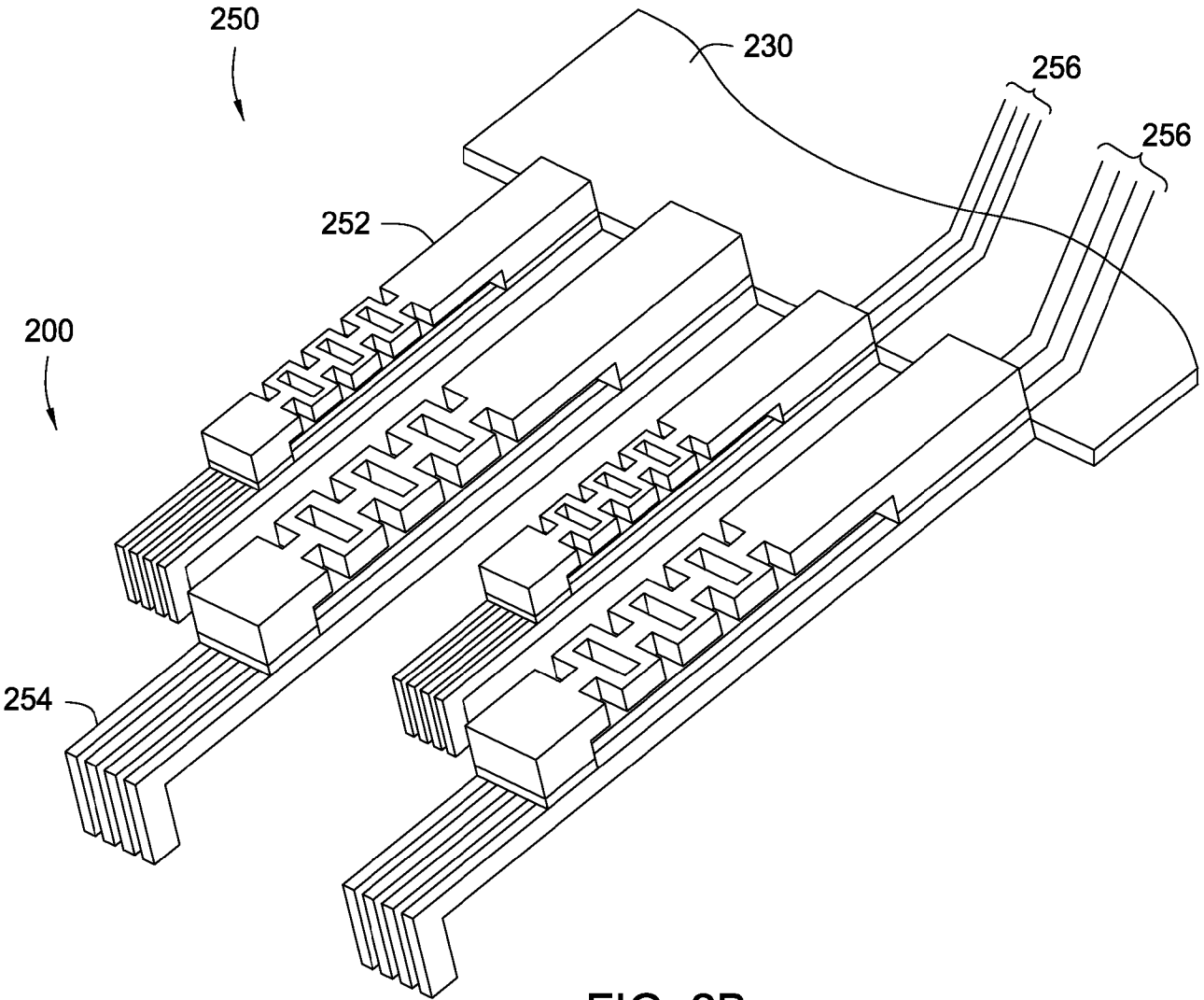

The reinforcement member 122 generally comprises a member 110 having a first end 109, a second end 111, and a resilient portion 114 disposed therebetween. The first and second ends 109, 111 of the member 110 are generally coupled to the beam 102 of the resilient element 120. In some embodiments, the first and second ends 109, 111 of the member 110 are coupled to the beam 102 proximate the first and second ends 107, 108 thereof. Alternatively, and as shown in FIG. 1, the first end 109 of the member 110 is coupled to the beam 102 at a point disposed between the first and second ends 107, 108 thereof. Optionally, in embodiments where the second end 108 of the beam 102 is coupled to a base or other supporting structure (not shown), the second end 111 of the member 110 may be coupled to the supporting structure instead of the beam 102. In other embodiments, the member 110 may be affixed to a plurality of beams 102 (for example, as shown in FIGS. 2A-B, below). Although FIGS. 2A-B show four beams, fewer or more could be coupled to the reinforcement member 252.

The member 110 may be affixed to the beam 102 of the resilient element 120 in any suitable manner, such as by gluing, bonding, welding, and the like. In some embodiments, the member 110 may be electrically insulated from the beam 102 or the plurality of beams 102 by at least one of the selection of materials comprising the member 110, the presence of an intervening dielectric layer (not shown), or by the mechanism used to affix the member 110 to the plurality of beams 102. In some embodiments, the member 110 is affixed to the beam 102 by an adhesive layer 112. In some embodiments, the adhesive layer 112 comprises an epoxy-based adhesive.

The member 110 may be fabricated from any material or combination of materials. In embodiments where the member 110 is affixed to a plurality of beams 102, the member 110 may be fabricated from a non-conductive material, or be otherwise electrically insulated from the plurality of beams 102. In one embodiment, the member 110 comprises materials suitable for bulk micromachining. In some embodiments, the member 110 comprises silicon.

The reinforcement member 122, when coupled to the resilient element 120, can provide a box spring configuration, thereby advantageously increasing the overall axial stiffness of the reinforced resilient element 100 (as used herein, axial stiffness refers to stiffness along the length, or long axis, of a component). The increased axial stiffness of the reinforced resilient element 100 can advantageously increase the force applied to a surface being contacted by the tip 106 when the reinforced resilient element 100 is deflected. The increased axial stiffness can further advantageously restrict lateral motion of the reinforced resilient element 100. The reinforcement member 122 can further advantageously reduces the probability of buckling and/or misalignment of the resilient element 120 during operation. In addition, the reinforcement member 122 can reduce the stress generated in the beam 102 of the resilient element 120 during deflection. In a non-limiting example, the reinforced resilient element 100 can further advantageously reduces the scrub distance by up to about 30 percent, as compared to conventional cantilevered contact elements having the same tip lengths. Moreover, the reinforced resilient element 100 may further have a longer tip 104 while minimizing the undesired increase in scrub distance resultant from a similar increase in tip length of a conventional cantilevered contact element.

The resilient portion 114 of the reinforcement member 122 can generally accommodate for some rotation of the reinforcement member 122 while maintaining relatively stiff axial spring force, thereby maintaining the benefit of the box spring configuration. For example, FIG. 2A shows an isometric view of a reinforced resilient element 200 having a reinforcement member 222 that includes the resilient portion 214. The resilient portion 214 has a rotational spring constant $K_R$ and an axial spring constant $K_A$ and can be configured such that the rotational spring constant $K_R$ is less than the axial spring constant $K_A$, thereby providing a greater degree of rotational flexibility while retaining a greater degree of stiffness in the axial direction. In some embodiments, the axial spring constant $K_A$ may be less than an axial spring constant proximate the first and second ends 109, 111 of the reinforcement member 122, thereby advantageously reducing the stress at the attachment points between the reinforcement member 122 and the resilient element 120.

The resilient portion (114, 214) of the reinforcement member (122, 222) may comprise any configuration suitable for providing the desired relative rotational and axial spring constants as described above. In a non-limiting example, the resilient portion 214 depicted in FIG. 2A comprises a plurality of torsional spring portions 203 alternatingly coupled to a plurality of links 204. The torsional spring portions 203 can facilitate rotation of the reinforced resilient element 100. The links 204 can facilitate reduction of stress at the attachment points between the reinforcement member 122 and the resilient element 120, as discussed above.

Figure 3A:
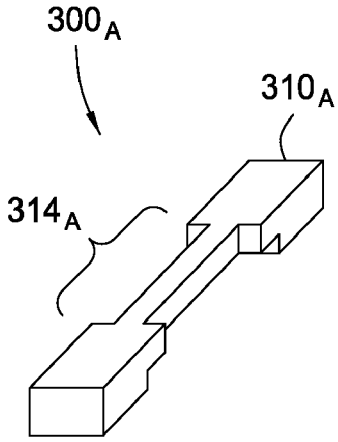
FIGS. 3A-B depict isometric views of some embodiments of a resilient portion of a reinforcement member in accordance with some embodiments the present invention.
Figure 3B:
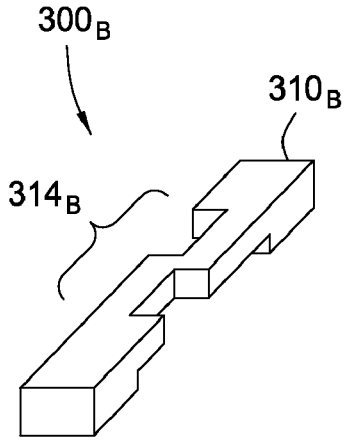

FIGS. 3A-B depict isometric views of two additional non-limiting illustrative embodiments of the resilient portion (e.g., resilient portions 114, 214, as depicted in FIGS. 1 and 2A). Specifically, FIG. 3A shows a reinforcement member $\mathbf{300}_A$ comprising a member $\mathbf{310}_A$ having a resilient portion $\mathbf{314}_A$ disposed therein. In this embodiment, the resilient portion $\mathbf{314}_A$ comprises a portion of the member $\mathbf{310}_A$ having a reduced width and/or thickness, thereby providing an area having a decreased rotational spring constant while maintaining a stiff, or higher, axial spring constant. FIG. 3B shows a reinforcement member $\mathbf{300}_B$ comprising a member $\mathbf{310}_B$ having a resilient portion $\mathbf{314}_B$ disposed therein. In this embodiment, the resilient portion $\mathbf{314}_B$ comprises a portion of the member $\mathbf{310}_B$ having material selectively removed from portions thereof, thereby also providing an area having a decreased rotational spring constant while maintaining a stiff, or higher, axial spring constant. It is contemplated that many other embodiments of resilient portions may be utilized to provide increased rotational flexibility of the reinforcement member while remaining stiff axially.

Returning to FIG. 1, in embodiments where the first end 109 of the member 110 is affixed to the beam 102 at a point disposed between the first and second ends 107, 108 thereof, the reinforcement member 122 can advantageously provide a region of global deflection 116 and a region of local deflection 107. The region of global deflection 116 is characterized by the greater axial stiffness provided by the reinforcement member 122 and facilitates the generation of greater contact forces at the tip 106 when deflected (for example when contacting a DUT during testing). The region of local deflection 118 has a lower axial stiffness and, therefore, greater ability to deflect. In one embodiment, the region of local deflection 118 (i.e., the region where the first end 107 of the beam 102 extends from the first end 109 of the member 110) is sufficiently long to allow at least 10 μm deflection of the first end 107 of the beam 102.

As discussed above, the reinforcement member may be coupled to a single resilient element (as shown in FIG. 1) or a plurality of resilient elements (as shown in FIGS. 2A-B). FIG. 2A depicts an isometric view of a reinforced resilient element 200 having a reinforcement member 222 coupled to a plurality of resilient elements 220. The resilient elements 220 are similar to the resilient elements 120 described above with respect to FIG. 1 (having beams 202 with respective first and second ends 207, 208). The reinforcement member 222 generally includes a member 210 coupled to the plurality of resilient elements 220 and having a resilient portion 214 disposed therein. The reinforcement member 222 provides a region of global deflection 216 disposed along the region coincident with the reinforcement member 222 and a region of local deflection 218 along the portion of the plurality of resilient elements 220 that extend beyond the reinforcement member 222. The regions of global and local deflection 216, 218 are similar to the regions of global and local deflection 116, 118 described above with respect to FIG. 1. In addition, the region of local deflection 218 provides for the independent movement of respective first ends 207 of the beams 202, thereby facilitating more robust contact, for example, when interfacing with terminals of a DUT or other surface having local non-planarities. In some embodiments, the region of local deflection 218 can provide for at least 10 μm of independent deflection capability for each of the respective first ends 207 of the beams 202. Such local deflection can accommodate local non-planarity and can assist in providing reliable electrical contact across the reinforcement array.

The plurality of resilient elements 220 may be arranged in any pattern. For example, in the embodiment of FIG. 2A the plurality resilient elements 220 are generally parallel and have a uniform pitch. However, it is contemplated that the plurality of resilient elements 220 may be arranged in other patterns such as having varying pitch between each of the resilient elements 220, having a first pitch between respective first ends 207 of the beams 202 and a different, second pitch between respective second ends 208 of the beams 202 (i.e., the plurality of resilient elements 220 may be non-parallel), and the like. In addition, the plurality of resilient elements 220 may be fanned, curved, or have other shapes, and the like.

FIG. 2B depicts one example of an array 250 of reinforced resilient elements 200, wherein a first group of reinforced resilient elements 252 may have a first size, configuration, or the like, and a second group of resilient elements 254 may have a second size, configuration, or the like that is different from the first. Each of the groups of reinforced resilient elements 252, 254 may be coupled to a support structure 230 that supports the reinforced resilient elements 252, 254. Conductive pathways 256 for electrically communicating between the respective tips of the reinforced resilient elements 200 and a test system (not shown) may be provided on or through the support structure 230, as described in more detail below.

Figure 4:
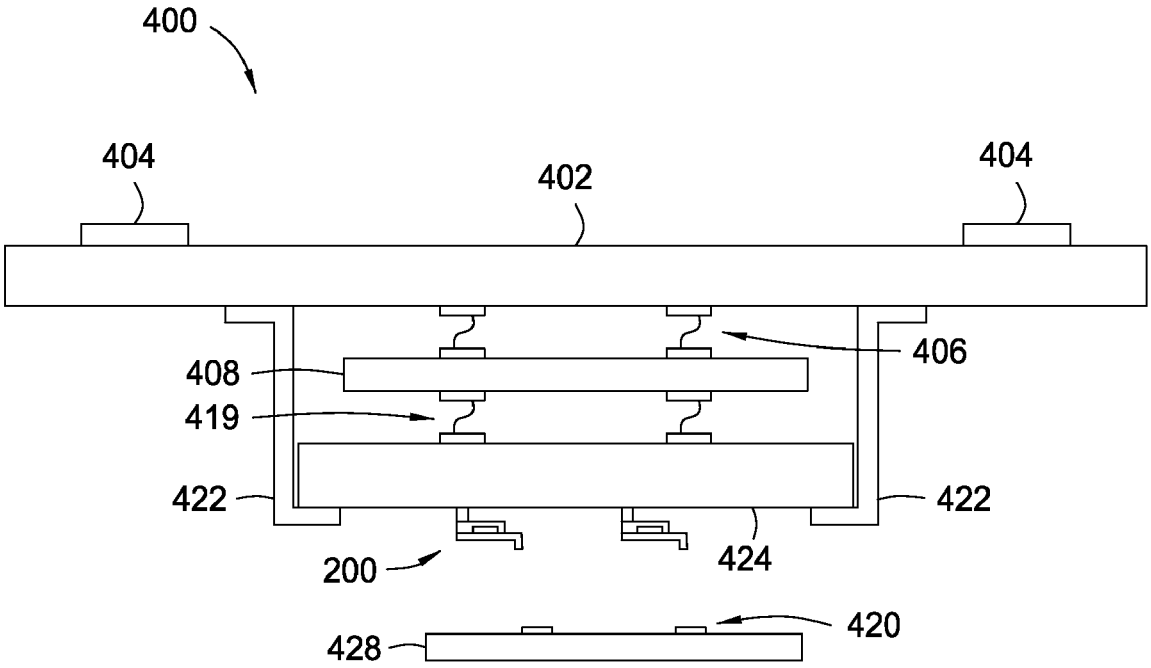
FIG. 4 depicts a schematic side view of a probe card assembly having a reinforced resilient element according to some embodiments of the present invention.

FIG. 4 depicts a schematic view of a probe card assembly 400 having one or more reinforced resilient elements 200 as described herein according to some embodiments of the invention. The exemplary probe card assembly 400 illustrated in FIG. 4 can be used to test one or more electronic devices (represented by DUT 428). The DUT 428 can be any electronic device or devices to be tested. Non-limiting examples of a suitable DUT include one or more dies of an unsingulated semiconductor wafer, one or more semiconductor dies singulated from a wafer (packaged or unpackaged), an array of singulated semiconductor dies disposed in a carrier or other holding device, one or more multi-die electronics modules, one or more printed circuit boards, or any other type of electronic device or devices. The term DUT, as used herein, refers to one or a plurality of such electronic devices.

The probe card assembly 400 generally acts as an interface between a tester (not shown) and the DUT 428. The tester, which can be a computer or a computer system, typically controls testing of the DUT 428, for example, by generating test data to be input into the DUT 428, and receiving and evaluating response data generated by the DUT 428 in response to the test data. The probe card assembly 400 includes electrical connectors 404 configured to make electrical connections with a plurality of communications channels (not shown) from the tester. The probe card assembly 400 also includes one or more reinforced resilient elements 200 configured to be pressed against, and thus make electrical connections with, one or more input and/or output terminals 420 of DUT 428. The reinforced resilient elements 200 are typically configured to correspond to the terminals 420 of the DUT 428 and may be arranged in one or more arrays having a desired geometry.

The probe card assembly 400 may include one or more substrates configured to support the connectors 404 and the reinforced resilient elements 200 and to provide electrical connections therebetween. The exemplary probe card assembly 400 shown in FIG. 4 has three such substrates, although in other implementations, the probe card assembly 400 can have more or fewer substrates. In the embodiment depicted in FIG. 4, the probe card assembly 400 includes a wiring substrate 402, an interposer substrate 408, and a probe substrate 424. The wiring substrate 402, the interposer substrate 408, and the probe substrate 424 can generally be made of any type of suitable material or materials, such as, without limitation, printed circuit boards, ceramics, organic or inorganic materials, and the like, or combinations thereof.

Electrically conductive paths (not shown) may be provided from the connectors 404 through the wiring substrate 402 to a plurality of electrically conductive spring interconnect structures 406. Other electrically conductive paths (not shown) may be provided from the spring interconnect structures 406 through the interposer substrate 408 to a plurality of electrically conductive spring interconnect structures 419. Still other electrically conductive paths (not shown) may further be provided from the spring interconnect structures 419 through the probe substrate 424 to the reinforced resilient elements 200. The electrically conductive paths through the wiring substrate 402, the interposer substrate 408, and the probe substrate 424 can comprise electrically conductive vias, traces, or the like, that may be disposed on, within, and/or through the wiring substrate 402, the interposer substrate 408, and the probe substrate 424.

The wiring substrate 402, the interposer substrate 408, and the probe substrate 424 may be held together by one or more brackets 422 and/or other suitable means (such as by bolts, screws, or other suitable fasteners). The configuration of the probe card assembly 400 shown in FIG. 4 is exemplary only and is simplified for ease of illustration and discussion and many variations, modifications, and additions are contemplated. For example, a probe card assembly may have fewer or more substrates (e.g., 402, 408, 424) than the probe card assembly 400 shown in FIG. 4. As another example, a probe card assembly may have more than one probe substrate (e.g., 424), and each such probe substrate may be independently adjustable. Non-limiting examples of probe card assemblies with multiple probe substrates are disclosed in U.S. patent application Ser. No. 11/165,833, filed Jun. 24, 2005. Additional non-limiting examples of probe card assemblies are illustrated in U.S. Pat. No. 5,974,662, issued Nov. 2, 1999 and U.S. Pat. No. 6,509,751, issued Jan. 21, 2003, as well as in the aforementioned U.S. patent application Ser. No. 11/165,833. It is contemplated that various features of the probe card assemblies described in those patents and application may be implemented in the probe card assembly 400 show in FIG. 4 and that the probe card assemblies described in the aforementioned patents and application may benefit from the use of the inventive reinforced resilient elements disclosed herein.

Figure 5:
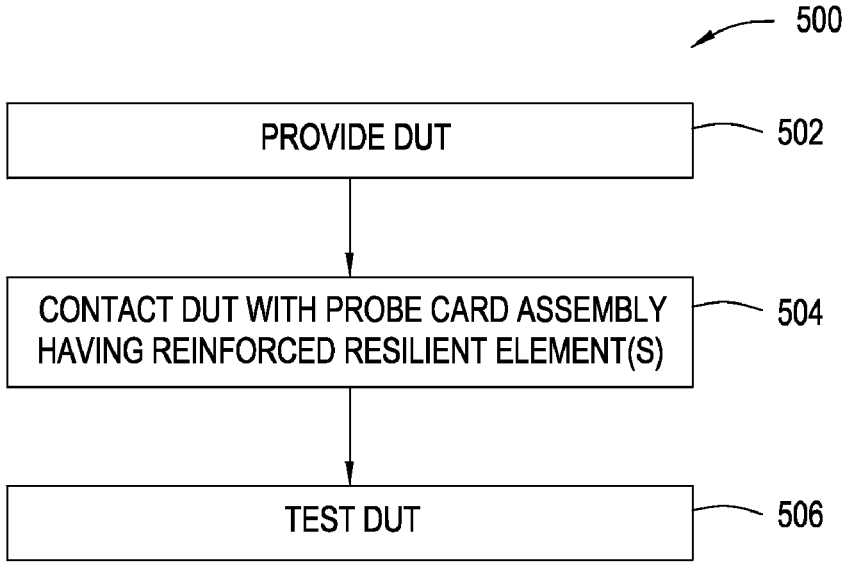
FIG. 5 depicts a flow chart of a method of testing a device according to some embodiments of the present invention.

FIG. 5 depicts a method 500 for testing a DUT with a probe card assembly having reinforced resilient elements according to some embodiments of the invention. The method 500 can be described with respect to the probe card assembly 400 described above with respect to FIG. 4. The method 500 begins at step 502, where a DUT 428 is provided. The DUT 428 can be generally disposed upon a movable support within a test system (not shown). Next, at step 504, the terminals 420 of the DUT 428 are brought into contact with the probe card assembly 400 having reinforced resilient elements (e.g., such as reinforced elements 100, 200). The reinforced resilient elements 200 can be brought into contact with the terminals 420 of the DUT 428 by moving at least one of the DUT 428 or the probe card assembly 400. Typically, the DUT 428 is disposed on a movable support disposed in the test system (not shown) that moves the DUT 428 into sufficient contact with the reinforced resilient elements 200 to provide reliable electrical contact with the terminals 420.

When moving the DUT 428 to contact the reinforced resilient elements 200 of the probe card assembly 400, the DUT 428 typically continues to move towards the probe card assembly 400 until all of the reinforced resilient elements 200 come into sufficient electrical contact with the terminals 420. Due to any non-planarity of the respective tips of the reinforced resilient elements 200 disposed on the probe card assembly 400 and/or any non-planarity of the terminals 420 of the DUT 428, the DUT 428 may continue to move towards the probe card assembly 400 for an additional distance after the initial contact of the first reinforced resilient element 200 to suitably contact each of the terminals 420 of the DUT 428 (sometimes referred to as overtravel). In a non-limiting example, such a distance could be about 1-4 mils (about 25.4-102 μm). Accordingly, some of the reinforced resilient elements 200 may undergo more deflection than others. However, the regions of local deflection can advantageously allow each respective tip of the reinforced resilient elements 200 to independently deflect while still providing suitable contact forces to establish a reliable electrical connection suitable for testing (e.g., break through any oxide layers present on the terminals 420 of the DUT 428).

Next, at step 506, the DUT 428 may be tested per a predetermined protocol, for example, as contained in the memory of the tester. For example, the tester may generate power and test signals that are provided through the probe card assembly 400 to the DUT 428. Response signals generated by the DUT 428 in response to the test signals are similarly carried through the probe card assembly 400 to the tester, which may then analyze the response signals and determine whether the DUT 428 responded correctly to the test signals. Upon completion of testing, the method ends.

Figure 6:
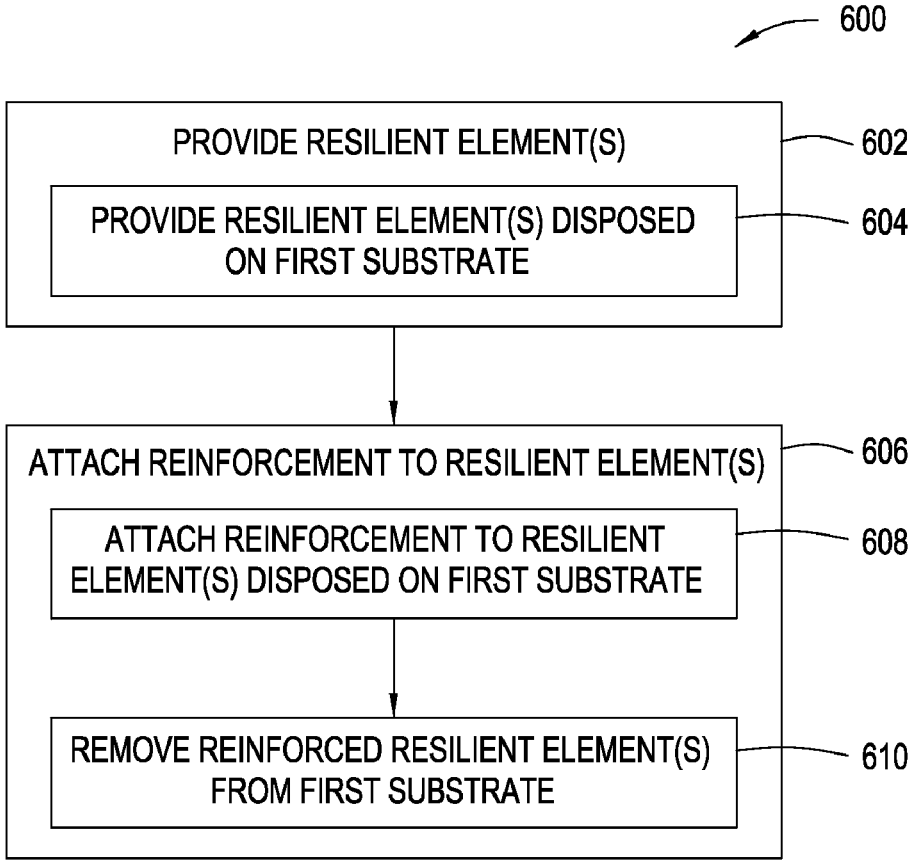
FIG. 6 depicts a flow chart of a method of fabricating a reinforced resilient element according to some embodiments of the present invention.

FIG. 6 depicts a method 600 for fabricating a reinforced resilient element in accordance with embodiments of the present invention. The method beings at step 602, wherein one or more resilient elements are provided. The resilient elements may be similar to resilient elements 120, 220 described above with respect to FIGS. 1 and 2A-B and may be arranged in any fashion. For example, step 602 may comprise a sub-step 604, wherein resilient elements are disposed on a first substrate, and wherein the first substrate supports the plurality of resilient elements in a desired geometry, such as parallel, fanned, having a desired pitch, and the like.

Next, at step 606, a reinforcement member is coupled to the plurality to the one or more resilient elements. As discussed above, a single reinforcement member may be attached to one or a plurality of resilient elements to secure their relative positions with respect to each other. Step 606 may further comprise sub-step 608, wherein the reinforcement member is attached to a plurality of resilient elements disposed on the first substrate as discussed above with respect to sub-step 604.

Next, at step 610, the reinforced resilient elements are removed from the first substrate to free the reinforced resilient elements. Thus, the reinforced resilient elements may be provided, singly or in groups, and optionally attached to a first substrate to hold pluralities of resilient elements in a desired geometry or layout. The reinforced resilient elements further may be subsequently attached to a base, such as the base 230, described above with respect to FIG. 2B. Alternatively, the resilient elements and the base 230 may be provided together during step 602—optionally on the first substrate—prior to attaching the reinforcement member to the resilient elements during step 606. Upon the completion of step 608, the method ends. One or more of the completed reinforced resilient elements may subsequently be secured to a probe card assembly, such as the probe card assembly 400 discussed above with respect to FIG. 4.

Figure 7:
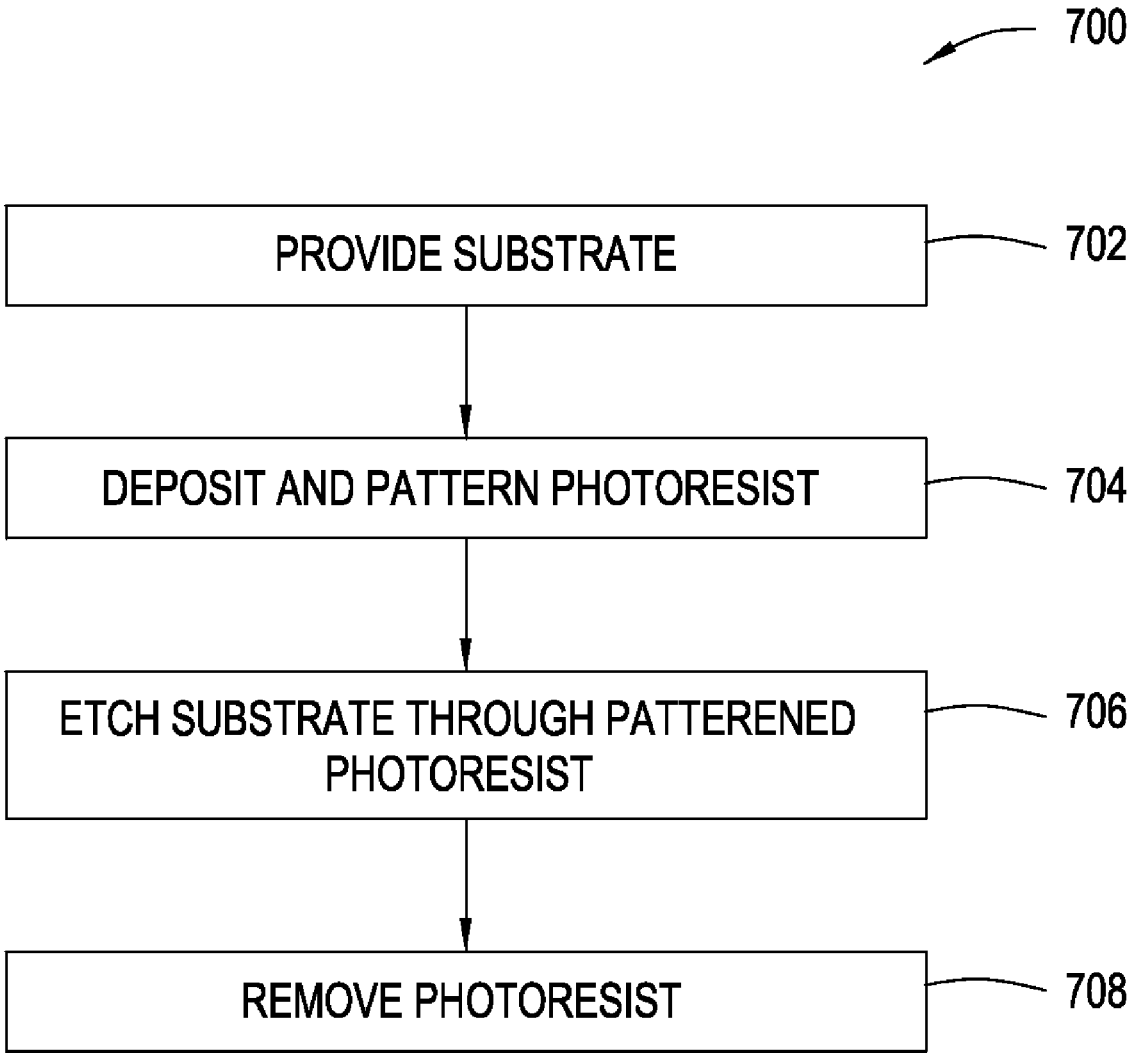
FIG. 7 depicts a flow chart of a method of fabricating a reinforcement member of a reinforced resilient element according to some embodiments of the present invention.

FIG. 7 depicts a method 700 for fabricating a reinforcement member, such as the reinforcement members described above with respect to FIGS. 1-3B, according to some embodiments of the invention. The method 700 begins at step 702, wherein a substrate is provided. The substrate comprises a material or materials suitable for forming the reinforcement member as discussed above with respect to FIG. 1. Next, at step 704, a layer of photoresist is deposited and patterned in a desired geometry to create a pattern corresponding to the desired shape of the reinforcement member and the resilient portion disposed therein (such as shown in FIGS. 2A-B, 3A-B, and the like). Next, at step 706, the substrate is etched through the patterned photoresist to form the desired features in the reinforcement member. Next, at step 708, the photoresist is removed and the reinforcement member is freed from the substrate. The reinforcement member may then be attached to one or more resilient elements, for example, as discussed above with respect to FIG. 6.

Thus methods and apparatus suitable for testing devices having reduced feature sizes (e.g., under 50 microns), and methods for fabricating same, have been provided herein. The inventive apparatus and methods facilitate testing of such devices with reduced incidence of damage to the resilient contact elements utilized to contact the devices. The inventive apparatus further advantageously provides a reduced scrub distance of up to about 30 percent, as compared to conventional cantilevered contact elements.

While the foregoing is directed to embodiments of the present invention, other and further embodiments of the invention may be devised without departing from the basic scope thereof, and the scope thereof is determined by the claims that follow.

The invention claimed is:

1. A reinforced resilient element for testing unpackaged semiconductor devices, comprising:

a resilient element configured to electrically probe an unpackaged semiconductor device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is disposed in a spaced apart relation to the resilient element, and wherein the reinforcement member is electrically isolated from the resilient element.

2. The reinforced resilient element of claim 1, wherein the reinforced resilient element has a reduced scrub distance when contacting a DUT as compared to a cantilevered contact element having the same tip length.

3. The reinforced resilient element of claim 1, wherein the reinforcement member comprises silicon.

4. The reinforced resilient element of claim 1, wherein the resilient portion of reinforcement member has a lower rotational spring constant than an axial spring constant.

5. The reinforced resilient element of claim 1, wherein the resilient portion comprises a torsional spring.

6. The reinforced resilient element of claim 1, wherein the second end of the reinforcement member is affixed to the resilient element.

7. The reinforced resilient element of claim 1, wherein the second end of the reinforcement member is affixed to a support structure coupled to the resilient element.

8. The reinforced resilient element of claim 1, wherein the reinforcement member is affixed to the resilient element by an adhesive.

9. The reinforced resilient element of claim 1, wherein the first end of the reinforcement member is affixed to the resilient element at a point disposed between the first and second ends of the resilient element.

10. The reinforced resilient element of claim 9, further comprising:

a plurality of resilient elements as defined in claim 1 each affixed to the reinforcement member.

11. The reinforced resilient element of claim 10, wherein the second end of the reinforcement member is coupled to a support structure.

12. The reinforced resilient element of claim 10, wherein the reinforcement member is electrically isolated from the plurality of resilient elements.

13. The reinforced resilient element of claim 1, wherein the resilient element is lithographically formed.

14. A probe card assembly for testing unpackaged semiconductor devices, comprising:

a probe substrate; and at least one reinforced resilient element coupled to the probe substrate comprising:

a resilient element configured to electrically probe an unpackaged semiconductor device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is disposed in a spaced apart relation to the resilient element, and wherein the reinforcement member is electrically isolated from the resilient element.

15. The probe card assembly of claim 14, wherein the reinforcement member comprises silicon.

16. The probe card assembly of claim 14, wherein the resilient portion of reinforcement member has a lower rotational spring constant than an axial spring constant.

17. The probe card assembly of claim 14, wherein the resilient portion comprises a torsional spring.

18. The probe card assembly of claim 14, wherein the reinforcement member is affixed to the resilient element by an adhesive.

19. The probe card assembly of claim 14, wherein the first end of the reinforcement member is affixed to the resilient element at a point disposed between the first and second ends of the resilient element.

20. The probe card assembly of claim 19, further comprising:

a plurality of resilient elements each affixed to the reinforcement member.

21. The probe card assembly of claim 20, wherein the second ends of the plurality of resilient elements are coupled to a support structure.

22. The probe card assembly of claim 21, wherein the second end of the reinforcement member is coupled to the support structure.

23. The probe card assembly of claim 20, wherein the reinforcement member is electrically isolated from the plurality of resilient elements.

24. The probe card assembly of claim 14, wherein the resilient element is lithographically formed.

25. A method of fabricating an apparatus for use in testing an unpackaged semiconductor device, comprising:

providing a resilient element configured to electrically probe the unpackaged semiconductor device to be tested, the resilient element having a first end and an opposing second end; and affixing a first end of a reinforcement member to the resilient element at the first end thereof or at a point disposed between the first and the second ends of the resilient element, wherein the reinforcement member has an opposing second end disposed in a direction towards the second end of the resilient element, and a resilient portion disposed between the first and second ends of the reinforcement member maintained in a spaced apart relation to the resilient element, and wherein the reinforcement member is electrically isolated from the resilient element.

26. The method of claim 25, wherein the step of affixing further comprises affixing the reinforcement member to the resilient element using an adhesive.

27. The method of claim 25, further comprising:

etching the resilient portion in the reinforcement member.

28. The method of claim 25, further comprising:

fabricating the reinforcement member from silicon.

29. The method of claim 25, further comprising:

providing a plurality of resilient elements; and affixing the first end of the reinforcement member to the plurality of resilient elements as described in claim 25.

30. The method of claim 29, wherein the plurality of resilient elements are electrically isolated from the reinforcement member.

31. The method of claim 29, further comprising:

affixing the second end of the reinforcement member to the plurality of resilient elements proximate their respective second ends.

32. The method of claim 29, further comprising:

fabricating the plurality of resilient elements on a first substrate;

affixing the reinforcement member to the plurality of resilient elements; and freeing the plurality of reinforced resilient elements from the first substrate.

33. The method of claim 32, further comprising:

integrally fabricating a support structure in the first substrate coupled to the respective second ends of the plurality of resilient elements.

34. A method of testing an unpackaged semiconductor device, comprising:

providing a probe card assembly comprising a probe substrate having a plurality of reinforced resilient elements coupled thereto, the reinforced resilient elements comprising:

a resilient element configured to electrically probe an unpackaged semiconductor device to be tested, the resilient element having a first end and an opposing second end; and a reinforcement member having a first end affixed to the resilient element at the first end thereof or at a point disposed between the first and the second ends of the resilient element, an opposing second end disposed in a direction towards the second end of the resilient element, and a resilient portion disposed between the first and second ends, wherein the resilient portion is disposed in a spaced apart relation to the resilient element, and wherein the reinforcement member is electrically isolated from the resilient element;

contacting a plurality of terminals of the device with respective reinforced resilient elements; and providing one or more electrical signals to at least one of the terminals through the probe substrate.

35. The method of claim 34, wherein the step of contacting further comprises:

moving at least one of the probe card assembly or the device to establish an initial contact between the plurality of terminals of the device and the tips of the reinforced resilient elements; and further moving at least one of the probe card assembly or the device to establish a desired contact pressure between the plurality of terminals of the device and respective tips of the contact elements.

36. The method of claim 34, wherein the reinforcement member is coupled to a plurality of resilient elements.

37. A semiconductor device tested by the method of claim 34.

* * * * *